US005201527A

United States Patent [19]

Koket

[11] Patent Number: 5,201,527

[45] Date of Patent: Apr. 13, 1993

[54] TOSSING GAME TARGETS AND METHOD

[76] Inventor: George T. Koket, 322 Forest Dr., Erie, Pa. 16505

[21] Appl. No.: 839,632

[22] Filed: Feb. 21, 1992

[51] Int. Cl.[5] ..... A63B 63/00

[52] U.S. Cl. ..... 273/402

[58] Field of Search ..... 273/402, 415

[56] References Cited

U.S. PATENT DOCUMENTS

| | | | |
|---|---|---|---|
| 922,717 | 5/1909 | Parker | 273/415 X |
| 1,636,920 | 7/1927 | Nichols | 273/415 |
| 2,815,955 | 12/1957 | Dear | 273/410 |
| 2,873,969 | 2/1959 | Ziel | 273/402 X |
| 2,902,239 | 9/1959 | Janecka, Jr. | 248/197 |
| 3,628,793 | 12/1971 | Mudloff | 273/402 |
| 3,837,650 | 9/1974 | Haney | 273/415 X |
| 4,210,326 | 7/1980 | Booth et al. | 273/26 A |
| 4,905,996 | 3/1990 | Tallent et al. | 273/410 X |
| 4,943,065 | 7/1990 | DeLapa | 273/402 |
| 4,961,586 | 10/1990 | Conville | 273/402 |
| 5,002,274 | 3/1991 | Bidema | 273/410 X |
| 5,056,796 | 10/1991 | Conville | 273/402 |

*Primary Examiner*—William H. Grieb

*Attorney, Agent, or Firm*—Lovercheck and Lovercheck

[57] ABSTRACT

A tossing game and method wherein two targets each having a pair of folding legs, a pair of upper and lower connectors, a body and a body wall enclose a target aperture. The folding legs are hingedly connected to the body and adapted to be folded into a folded position. The connectors are adapted to be connected while the folding legs are in the folded position. Each target body is made of plastic. Tossing bags are supported by target bodies.

5 Claims, 2 Drawing Sheets

TOSSING GAME TARGETS AND METHOD

BACKGROUND OF THE INVENTION

The invention relates to tossing game targets. The invention provides improved tossing game targets which are readily connected and carried in pairs with their legs folded. The improvements of the invention each taken alone or in combination add to resolve the problems of the prior art.

Applicant is aware of the following U.S. patents:

Nichols in U.S. Pat. No. 1,636,920 and Parker in U.S. Pat. No. 922,717 disclose games.

Dear in U.S. Pat. No. 2,815,955 discloses an apparatus for recovering projectiles.

Ziel in U.S. Pat. No. 2,873,969 discloses a baseball control developer and tester.

Janecka in U.S. Pat. No. 2,902,239 discloses a collapsible display device.

Haney in U.S. Pat. No. 3,837,650 discloses a collapsible tossing game target.

Tallent et al in U.S. Pat. No. 4,905,996 and Booth et al in U.S. Pat. No. 4,210,326 disclose ball target apparatus.

Bidema in U.S. Pat. No. 5,002,274 discloses a baseball batting practice device.

SUMMARY OF THE INVENTION

A tossing game and method wherein two targets each having a pair of folding legs, a pair of upper and lower connectors, a body and a body wall enclose a target aperture. The folding legs are hingedly connected to the body and adapted to be folded into a folded position. The connectors are adapted to be connected while the folding legs are in the folded position. Each target body is made of plastic. Tossing bags are supported by target bodies.

One problem of the prior art tossing game targets is that they are not readily carried in pairs. Another problem of the prior art tossing game targets is that they are not readily connected and carried in pairs with their legs folded while supporting tossing bags. These problems of the prior art are overcome by the improved tossing game targets of the present invention. The improvements of the present invention beneficially provide a novel, non-obvious and useful manner of carrying tossing game targets.

It is an object of the invention to provide a method of playing a tossing game including a first and a second target each having a pair of folding legs, a front wall enclosing a target aperture, and connectors adapted to hold the targets in carrying position and to be disconnected, and each target being adapted to be supported by its legs, and a player then tossing the tossing bags through at least one of the target apertures.

It is an object of the invention to provide a tossing game including a first and a second target each having a pair of folding legs, a front wall enclosing a target aperture, and connectors adapted to hold the targets in carrying position.

It is an object of the invention to provide a tossing game including a first and a second target each having a pair of folding legs, a front wall enclosing a target aperture, and connectors adapted to hold the targets in carrying position and to be disconnected, and each target being adapted to be supported by its legs.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

BRIEF DESCRIPTION OF THE DRAWING(S)

DESCRIPTION OF THE PREFERRED EMBODIMENT(S)

Figure 1:
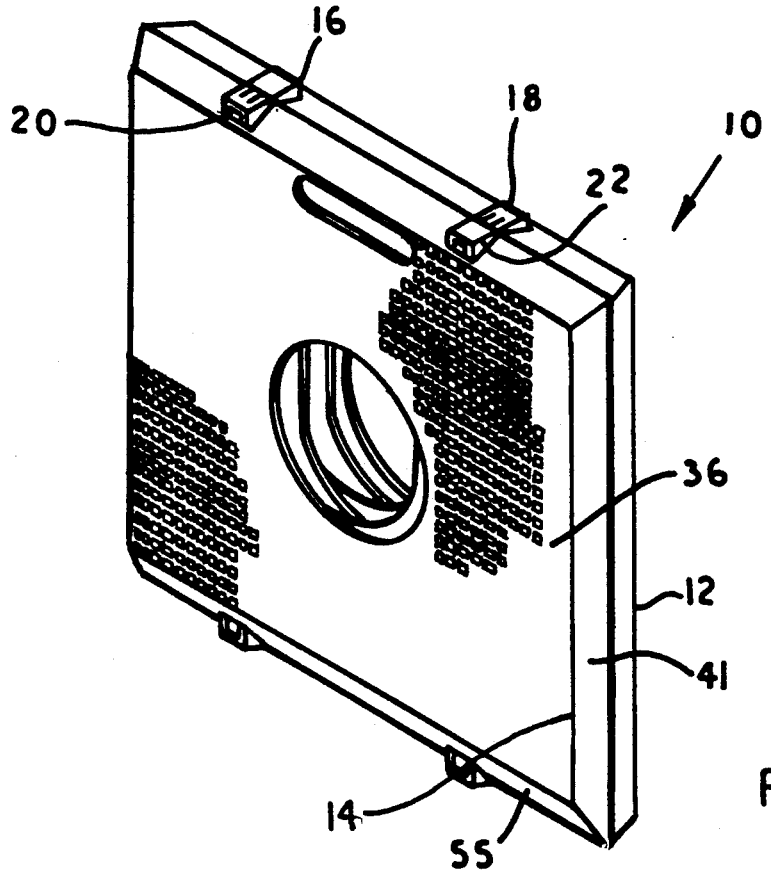
FIG. 1 is a perspective view of a tossing game including two targets in carrying position in accordance with the invention.

The preferred embodiment of the invention is illustrated by way of example in FIGS. 1–6. Referring to the FIGURES, in which like numerals refer to like portions thereof FIG. 1 shows tossing game 10 including targets 12 and 14 in a carrying position in accordance with the present invention. Top connectors 16 and 18 engage connectors 20 and 22 to hold targets 12 and 14 in a carrying position.

Figure 2:
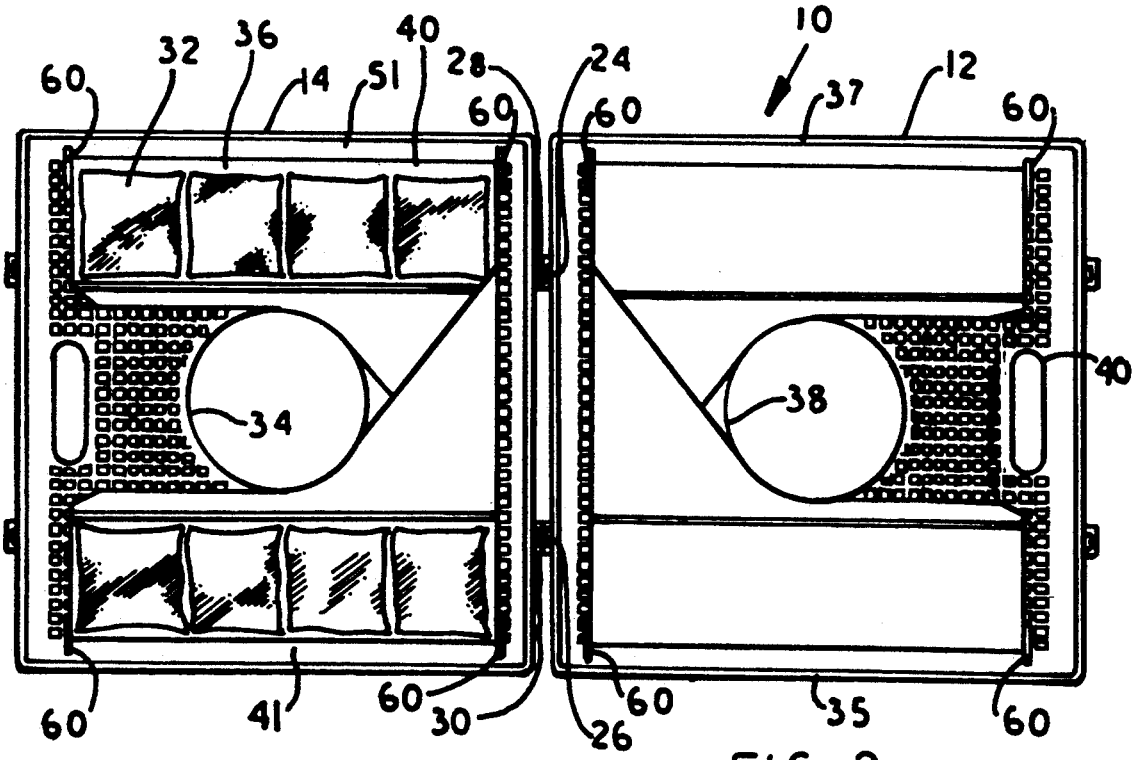
FIG. 2 is a top view of the tossing game including two targets in folded position in accordance with the invention.

With more particular reference to FIG. 2 it is seen that tossing game 10 includes targets 12 and 14 in an unfolded position in accordance with the invention. Bottom connectors 24 and 26 engage connectors 28 and 30 to hold targets 12 and 14 in a carrying position. Target 14 supports tossing bags 32.

Figure 3:
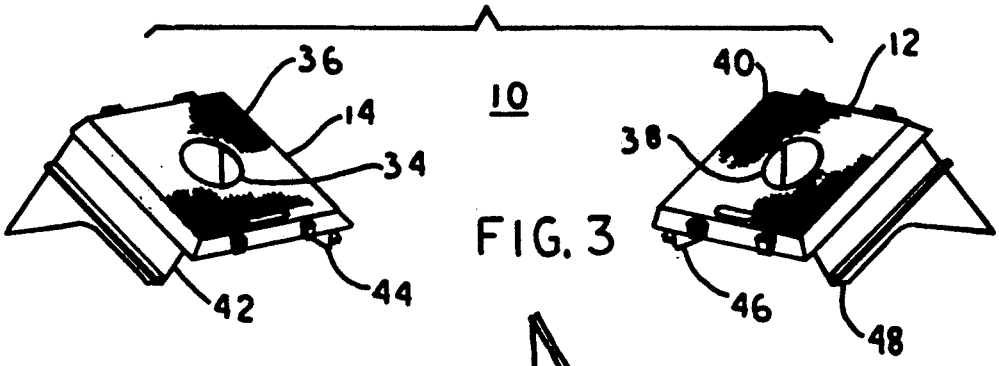
FIG. 3 is a perspective view of the tossing game including two targets in playing position in accordance with the invention.

With more particular reference to FIG. 3 tossing game 10, with targets 12 and 14 in playing position, is seen. Target 14 has aperture wall 34 enclosing a central target opening in front wall 36. Target 12 has aperture wall 38 enclosing a central target opening in front wall 40. Target 14 is supported in a playing position by legs 42 and 44 when legs 42 and 44 are resting against end walls 41 and 51. Each of legs 42, 44, 46 and 48 have side 29 remote from front walls 36 and 40 that incline relative to front walls 36 and 40 when first target 12 and second target 14 are supported on a supporting surface. Target 12 is supported in a playing position by legs 46 and 48 when legs 46 and 48 are in an unfolded position resting against end walls 37 and 39. Front walls 36 and 40 are perforated and each has a hand hold opening.

Figure 4:
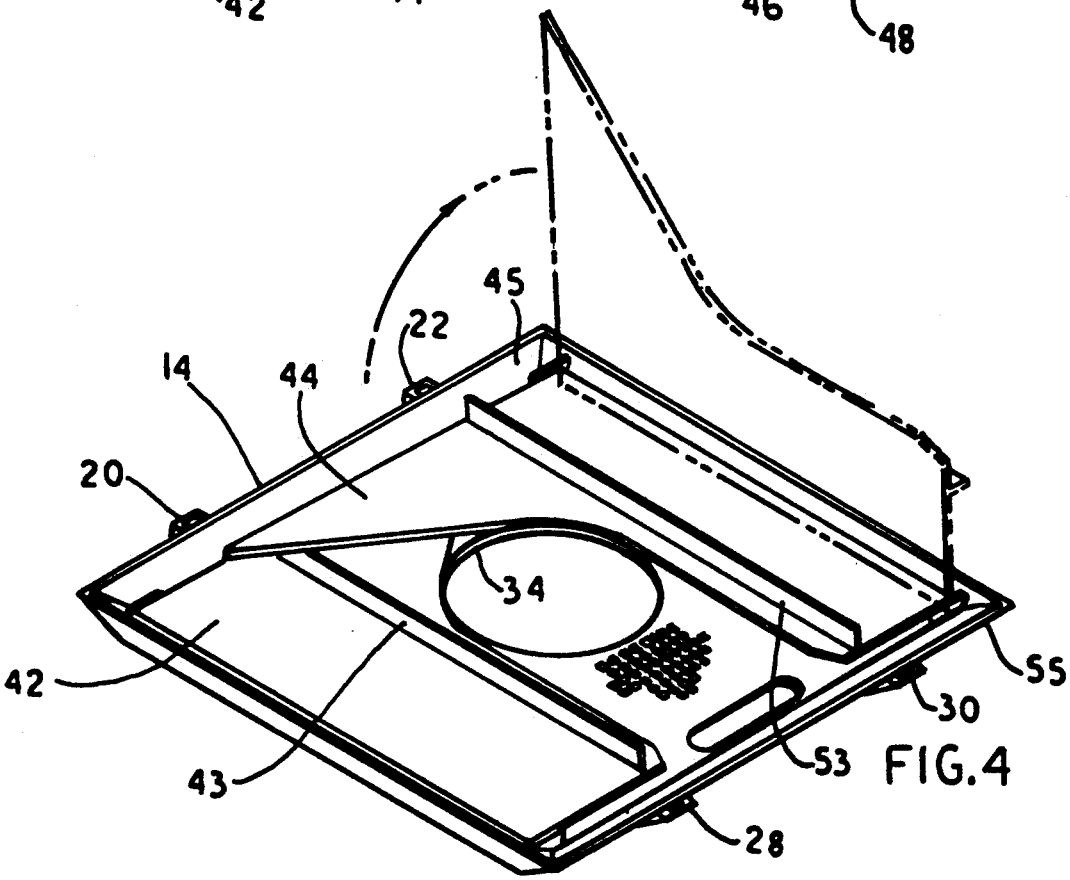
FIG. 4 is a perspective bottom view of a target of the tossing game in accordance with the invention being unfolded.

With more particular reference to FIG. 4 a perspective bottom view of target 14 being unfolded is seen. Legs 42 and 44 are hingedly connected by hinges 60 to front wall 36 and 40. Side walls 45 and 55 extend downwardly and outwardly and are integrally connected to end walls 41 and 51 and to each other. End walls 41 and 51 and side walls 45 and 55 are all connected to front wall 36. Leg 42 includes brace 43. Leg 44 includes brace 53.

Figure 5:
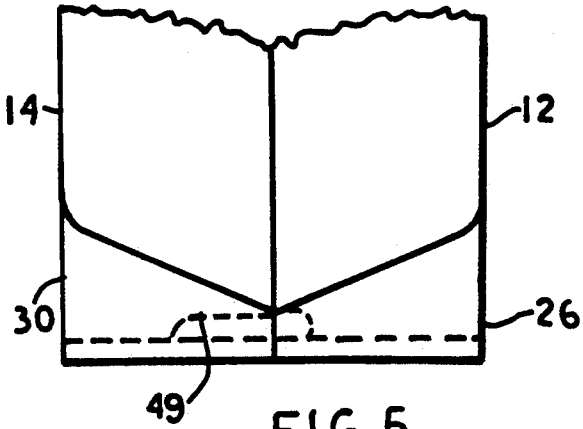
FIG. 5 is a partial side view of a target of the tossing game in accordance with the invention.
Figure 6:
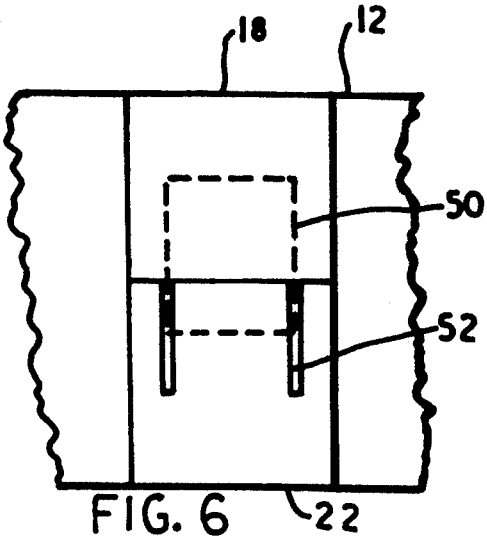
FIG. 6 is a partial top view of a target of the tossing game in accordance with the invention.

With more particular reference to FIG. 5 a partial side view of targets 12 and 14 is seen. Lower locking tab 49 holds connectors 26 and 30 together. Top connector 18 supports upper locking tab 50 as shown in FIG. 6. Top connector 22 supports release tab 52. Upper locking tab 50 engages release tab 52 to hold the targets in a carrying position.

OPERATION

In accordance with the invention a tossing game method is provided. The targets are disconnected and tossing bags removed. The legs are then unfolded, and each target is positioned on its pair of legs. A player then attempts to toss the tossing bags through at least one of the target apertures.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A tossing game comprising a first target, a second target and tossing bags;

said first target having a first leg, a second leg, a first side wall, a second side wall, a first end wall, a second end wall and a front wall;

said front wall of said first target having a central target opening;

said second target having a first leg, a second leg, a first side wall, a second side wall, a first end wall, a second end wall and a front wall;

said front wall of said second target having a central target opening;

said legs being adapted to fold into a folded position parallel to said front wall;

said legs adapted to be unfolded to an unfolded position extending outwardly and downwardly from said front wall generally parallel to said end walls and resting on said side walls;

said legs each having a side remote from said front wall inclined to said front wall when said legs are in an unfolded position whereby said legs hold said front wall in an inclined position relative to a supporting surface when said legs rest on said supporting surface.

2. The tossing game recited in claim 1 wherein said first and second targets are made of plastic.

3. The tossing game recited in claim 1 wherein said tossing bags are supported by said first and second targets.

4. The tossing game recited in claim 1 wherein each said front wall comprises a perforated face.

5. A tossing game comprising a first target and a second target substantially identical to one another;

each said target having a front wall, a first side wall, a second side wall, a first end wall and a second end wall;

said side walls and said end walls being integrally connected to one another;

each said side wall and each said end wall being integrally attached to said front wall and extending downwardly and outwardly therefrom;

a first leg, hingedly attached to said first side wall;

a second leg hingedly attached to said second side wall;

said legs being adapted to swing to a first position in a plane generally parallel to said front wall;

said legs being adapted to swing to a second position in engagement with said side walls and extending outwardly and downwardly to a supporting surface.

* * * * *